United States Patent [19]

Bathe

[11] Patent Number: 4,534,913

[45] Date of Patent: Aug. 13, 1985

[54] APPARATUS CONTROLLING DISCHARGE VOLUME OF A CARBURETOR ACCELERATOR PUMP

[75] Inventor: John G. Bathe, Taylor, Mich.

[73] Assignee: ACF Industries, Inc., New York, N.Y.

[21] Appl. No.: 572,805

[22] Filed: Jan. 23, 1984

[51] Int. Cl.[3] ..... F02M 7/08

[52] U.S. Cl. ..... 261/34 B

[58] Field of Search ..... 261/34 B, DIG. 74, DIG. 19, 261/69 A

[56] References Cited

U.S. PATENT DOCUMENTS

| | | | |
|---|---|---|---|
| 1,896,499 | 2/1933 | Tice | 261/34 B |
| 3,008,697 | 11/1961 | Dermond | 261/34 B |
| 3,371,914 | 3/1968 | Walker | 261/DIG. 19 |
| 3,588,058 | 6/1971 | Lucas | 261/69 A |
| 3,677,241 | 7/1972 | Gele et al. | 261/DIG. 19 |
| 3,907,941 | 9/1975 | Herbert et al. | 261/69 R |
| 3,942,494 | 3/1976 | Toda et al. | 261/34 B |
| 4,060,063 | 11/1977 | Hirasawa | 261/DIG. 19 |
| 4,076,770 | 2/1978 | Saito et al. | 261/34 B |
| 4,168,680 | 9/1979 | Kawai et al. | 261/DIG. 19 |

FOREIGN PATENT DOCUMENTS 55-146260 11/1980 Japan ..... 261/34 B

OTHER PUBLICATIONS

"Research Disclosure", Apr. 1978, No. 168, pp. 33, 34, anonymous 16850.

*Primary Examiner*—Tim Miles

*Attorney, Agent, or Firm*—J. Joseph Muller

[57] ABSTRACT

Apparatus (1) for use with a carburetor (C) to control the discharge volume from the carburetor's accelerator pump. A valve (5) controls flow of fuel from a fuel discharge port (O) of the pump. A vacuum operated means (9) moves the valve (5) from a position blocking fuel flow from the discharge port to a position permitting fuel flow. A switch (39) controls application of a vacuum to the vacuum operated means (9). A temperature sensor (57) senses engine coolant temperature and switches switch (39) when engine coolant reaches a predetermined temperature so the vacuum operated means (9) is exposed to atmosphere rather than engine vacuum.

7 Claims, 3 Drawing Figures

APPARATUS CONTROLLING DISCHARGE VOLUME OF A CARBURETOR ACCELERATOR PUMP

BACKGROUND OF THE INVENTION

This invention relates to carburetors having accelerator pumps, and more particularly, to apparatus for controlling the discharge volume of the accelerator pump.

Many carburetors employ an accelerator pump for providing an additional volume of fuel to the engine when the engine is accelerated. Typically, the accelerator pump has a discharge port through which the fuel is pumped to the throat of the carburetor. In addition, a return path is provided from the accelerator pump back to the carburetor fuel bowl and the accelerator pump has a second outlet by which fuel is directed back to the fuel bowl via this return path. This second accelerator pump outlet is closed when the engine is cold so the entire volume of fuel in the accelerator pump is directed to the throat of the carburetor. This is done to improve engine drive during cold engine operating conditions. However, when the engine is hot the outlet is opened and a portion of the pump volume is directed back to the fuel bowl.

Previously, the return or bleed passage between the accelerator pump and fuel bowl has been controlled by a bi-metallic switch which closes the passage at cold engine conditions and opens the passage when the engine is sufficiently warm. This bi-metallic switch has typically comprised a snap-over disk which has a high level of operating hysterisis. This causes problems particularly when the engine cold drive condition is in the 60°–80° Fahrenheit range. To prevent these problems, the snap-over point for the bi-metallic disk has had to be in the range of 95° Fahrenheit. However, it has been found that it takes a longer time for the disk to snap over when the disk is designed to operate at this high temperature level and as a result the engine is more responsive to air temperature than engine temperature.

SUMMARY OF THE INVENTION

Among the several objects of the present invention are the provision of apparatus for controlling the discharge volume of a carburetor's accelerator pump as a function of an engine operating condition; the provision of such apparatus to provide maximum accelerator pump delivery during cold engine operating conditions thereby to improve cold drive; the provision of such apparatus for tailoring accelerator pump delivery at hot engine operating conditions to minimize rich air/fuel ratio excursions and HC spikes; the provision of such apparatus which eliminates ambient sensitivity so the delivery mode of the accelerator pump is controlled directly by engine temperature rather than by ambient conditions; and, the provision of such apparatus which provides a relatively high temperature switch point so high temperature ambient cold starts benefit from the high delivery mode while a low delivery mode is provided for HC control due to rapid response to coolant temperature.

Briefly, apparatus of the present invention is for use with a carburetor attached to an internal combustion engine. The apparatus is for controlling the discharge volume of the carburetor's accelerator pump as a function of an engine operating condition. A flow control valve controls flow of fuel from a discharge port of the carburetor's accelerator pump. A vacuum operated means moves the flow control valve from a first position blocking flow of fuel from the discharge port to a second position permitting fuel flow. A switch controls application of vacuum to the vacuum operated means. Finally, a temperature sensor responsive to engine coolant temperature switches the switch from a position in which vacuum is applied to the vacuum operated means to a position in which the vacuum operated means is exposed to atmosphere. This causes the vacuum operated means to move the flow control means from its first to its second position. Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
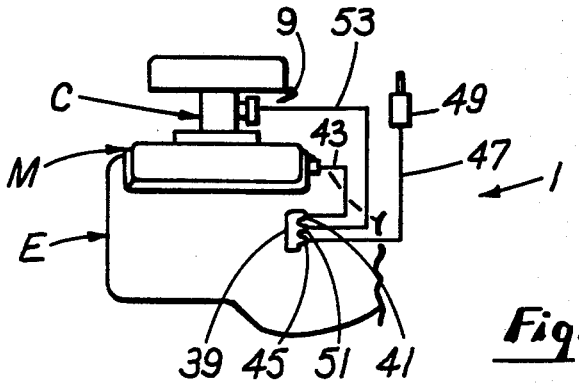
FIG. 1 illustrates the apparatus of the present invention installed on a carburetor attached to an internal combustion engine.

Referring to the drawings, apparatus of the present invention is indicated generally 1 and is for use with a carburetor C attached to an internal combustion engine E. The carburetor has an accelerator pump (not shown) by which additional amounts of fuel are supplied to the engine when the engine is accelerated. Further, the carburetor has a fuel bowl (also not shown) and a bypass outlet or orifice O permits fuel discharged from the accelerator pump to flow back to the fuel bowl under certain engine operating conditions. During cold engine operations, it is desirable for the entire volume of fuel pumped by the accelerator pump to be supplied to the engine. However, when the engine has warmed up and attained a nominal operating temperature, it is preferable for a portion of the fuel volume to be directed back to the fuel bowl rather than supplied to the engine.

Figure 3:
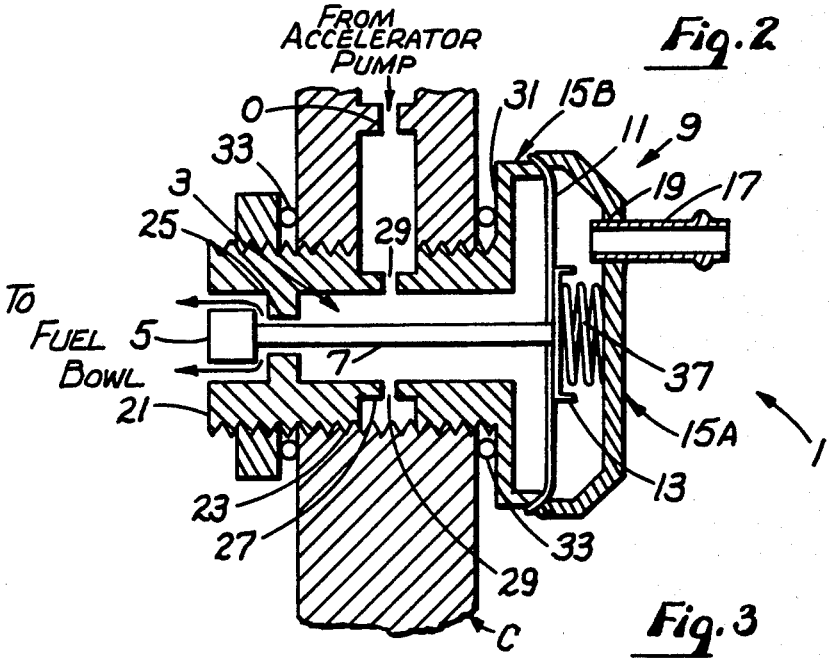

As shown in FIG. 3, apparatus 1 includes a flow control means 3 for controlling flow of fuel from fuel discharge port or orifice O on the accelerator pump. Means 3 includes a valve 5 attached to a stem 7. The function of valve 5 is to block and unblock the fuel passage between the accelerator pump outlet and the fuel bowl.

A vacuum operated means 9 moves valve 5 from a first position blocking flow of fuel from the discharge port to a second position permitting fuel flow. Means 9 includes a flexible diaphragm 11 one side of which is exposed to engine vacuum. Diaphragm 13 has an associated backing plate 13 located on the vacuum side thereof and the diaphragm and backing plate together form an assembly to which stem 7 is attached. Means 9 further includes a two-piece housing assembly 15A and 15B. Assembly portion 15A is of shallow-drawn cup-shaped construction. A nipple 17 is fitted into an appropriate opening 19 formed in the base or bottom of portion 15A.

Assembly portion 15B has an elongate cylindrical stem or shank portion which is externally threaded. Shank 21 is received in a threaded bore 23 formed in the side of carburetor C at the location of the return passage between the accelerator pump and the carburetor fuel bowl. Stem 21 is hollow and has a reduced diameter section 25 on its inner wall. The stem further has a cylindrical groove 27 on its outer surface approximately midway the length of the stem and a series of apertures 29, spaced circumferentially about the stem, extend through the side wall of the stem. When the housing assembly is installed in the side of the carburetor, stem 21 partially defines the return passage from the accelerator pump to the fuel bowl. Fuel flowing from outlet O of the accelerator pump flows into the hollow portion of the stem through apertures 29 and is directed through the orifice defined by inner reduced diameter section 25 to the fuel bowl. Valve member 5 is located on the fuel bowl side of the orifice defined by inner reduced diameter section 25 and stem 7 extends longitudinally of the stem through the opening defined by inner reduced diameter section 25.

Figure 2:
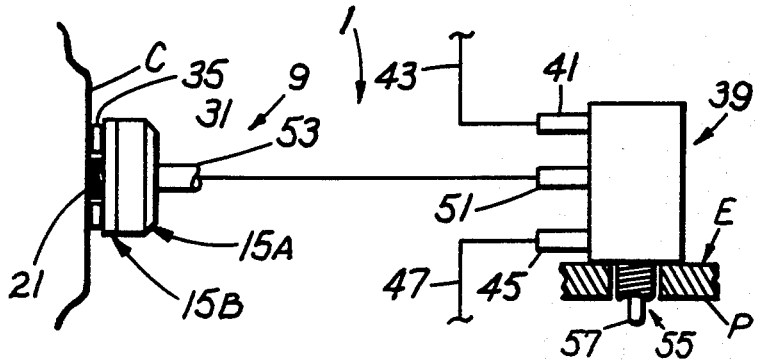
FIG. 2 is a further illustration of elements comprising the apparatus of the present invention; and, FIG. 3 is a sectional view of a portion of the apparatus of the present invention attached to the carburetor.

The Outer end 31 of housing portion 15B is of an enlarged diameter and is also of a shallow cup-shape. The outer margin of diaphragm 11 is captured between the outer rims of housing portions 15A and section 31 of housing portion 15B. The housing assembly portions 15A and 15B are joined together in any conventional manner to form a unified assembly. Appropriate seals such as the O rings 33 shown in FIG. 3 or the washer 35 shown in FIG. 2 are used to provide a fluid tight seal between vacuum operated means 9 and the body of carburetor C. As shown in FIG. 3, vacuum operated means 9 further includes a spring 37 acting on the diaphragm assembly to urge valve member 5 to the position opening the orifice defined by inner reduced diameter section 25 of stem 21.

Apparatus 1 next includes a switch 39 for controlling application of vacuum to vacuum operated means 9. Switch 39 has a first inlet 41 interconnected with engine intake manifold M via an appropriate conduit 43. The switch has a second inlet 45 which is exposed to atmosphere via an appropriate conduit 47 which includes an in-line filter 49. The switch also has an outlet 51 which is connected to vacuum operated means 9 by a conduit 53 whose outer end fits over nipple 17. Consequently, when switch 39 is one position, diaphragm 11 is exposed to manifold vacuum. The vacuum force exerted on the diaphragm assembly overcomes the bias of spring 37 to move the diaphragm assembly and consequently valve member 5 to the right as shown in FIG. 3 to block the passage between the accelerator pump and the carburetor fuel bowl.

Apparatus 1 includes means 55 responsive to an engine operating condition for switching switch 39 from its position in which manifold vacuum is applied to vacuum operated means 9 to a position in which the vacuum operated means is exposed to atmosphere. As shown in FIG. 2, switch 39 is mounted in the engine block of engine E and a temperature sensor 57 extends through the block into a coolant passage P which is formed in the engine block. The temperature sensor senses the temperature of the engine coolant and when the engine coolant reaches a predetermined temperture, which is, for example, 128° F., it causes switch 39 to expose vacuum operated means 9 to atmosphere rather than manifold vacuum. For this purpose, switch 39 may include a wax capsule which melts at a predetermined temperature. In any event, when the switching occurs at the predetermined temperature and diaphragm 11 is exposed to atmosphere rather than manifold vacuum, the force of spring 37 urges the diaphragm assembly to the left as shown in FIG. 3 and valve member 5 moves away from the orfice defined by the inner reduced diameter section 25 of stem 21 so to open the passage between the accelerator pump and the carburetor fuel bowl.

The result of using apparatus 1 is that more fuel is supplied to the engine when the accelerator pump is operated at cold engine conditions so to improve driveability of the engine at cold conditions. Further, it permits the pump delivery to be tailored for warm engine conditions because the switch point at which switch 39 exposes vacuum means 9 to atmosphere rather than engine vacuum is better controlled than with the conventional snap-over switches, so to minimize the rich air/fuel ratio excursions produced when the accelerator pump is operated. This, in turn, helps to reduce HC emission spikes which normally occur when the engine is accelerated.

In view of the above, it will be seen that the several objects of the invention are achieved and other advantageous results obtained.

As various changes could be made in the above constructions without departing from the scope of the invention, it is intended that all matter contained in the above description and shown in the accompanying drawing shall be interpreted as illustrative and not in a limiting sense.

What is claimed is:

1. Apparatus for use with a carburetor attached to an internal combustion engine for controlling the discharge volume of the carburetor's accelerator pump as a function of the engine operating condition comprising:

flow control means for controlling flow of fuel from a fuel discharge port of the accelerator pump to return fuel to a fuel bowl portion of the carburetor;

vacuum operated means for moving the flow control means from a first position blocking flow of fuel from the discharge port to a second position permitting fuel flow, the vacuum operated means including a diaphragm assembly one side of which is exposed to engine vacuum, a shank portion sized to be received in a bore formed in the side of the carburetor, the shank being hollow to form a portion of the return passage from the discharge port of the accelerator pump to the fuel bowl portion of the carburetor, the shank having a cylindrical groove therearound with a series of apertures circumferentially spaced for fuel to enter into the hollow shank;

switch means controlling application of a vacuum to the vacuum operated means; and, means responsive to an engine operating condition for switching the switch means from a position in which vacuum is applied to the vacuum operated means to a position in which the vacuum operated means is exposed to atmosphere whereby the vacuum operated means moves the flow control means from its first to its second position.

2. The apparatus of claim 1 further including spring means acting on the diaphragm to urge the flow control means to its second position.

3. The apparatus of claim 2 wherein the switch means has a first inlet interconnected with the engine intake manifold, a second inlet exposed to atmosphere and an outlet connected to the vacuum operated means.

4. The apparatus of claim 3 wherein the means responsive to an engine operating condition includes a temperature sensor for sensing engine coolant temperature and for switching the outlet of the switch means from the first inlet thereof to the second inlet thereof when the engine coolant reaches a predetermined temperature.

5. The apparatus of claim 4 further including a filter connected between the second inlet of the switch means and atmosphere.

6. The apparatus of claim 5 further including sealing means providing a seal between the carburetor and the vacuum means.

7. The apparatus of claim 1 wherein the flow control means comprises a valve for blocking and unblocking the passage, the valve being connected to the diaphragm assembly.

* * * * *